US006905021B2

(12) United States Patent
Polumbaum et al.

(10) Patent No.: US 6,905,021 B2
(45) Date of Patent: Jun. 14, 2005

(54) PALLET MEMBERS HAVING FEATURES FOR STORING BOXES AND OTHER ARTICLES

(75) Inventors: Douglas Polumbaum, New York, NY (US); Sean O'Meallie, Colorado, CO (US)

(73) Assignee: Douglas H. Polumbaum, New York, NY (US)

( * ) Notice: Subject to any disclaimer, the term of this patent is extended or adjusted under 35 U.S.C. 154(b) by 4 days.

(21) Appl. No.: 10/357,863

(22) Filed: Feb. 4, 2003

(65) Prior Publication Data

US 2004/0149609 A1 Aug. 5, 2004

(51) Int. Cl.[7] ..... B65D 19/00

(52) U.S. Cl. ..... 206/386; 206/600; 206/453; 206/451; 108/55.1

(58) Field of Search ..... 206/386, 598, 206/599, 600, 449, 453, 451; 108/55.1

(56) References Cited

U.S. PATENT DOCUMENTS 2,725,087 A * 11/1955 Potter ..... 206/598
3,523,694 A * 8/1970 Oliver ..... 280/33.998
4,454,946 A * 6/1984 Yokowo ..... 206/600
4,606,461 A * 8/1986 Bolton, Sr. ..... 206/600
5,487,471 A * 1/1996 Marchek et al. ..... 206/725
6,050,410 A * 4/2000 Quirion ..... 206/386
6,299,011 B1 * 10/2001 Rosenfeldt ..... 220/4.29
2003/0183544 A1 * 10/2003 Lawrence ..... 206/335

* cited by examiner

*Primary Examiner*—Jila M. Mohandesi
(74) *Attorney, Agent, or Firm*—Darby & Darby

(57) ABSTRACT

A pallet and storage container combination for retail sale is provided. The combination includes a pallet having a body including an outer surface for supporting a load and an inner surface. The pallet has a plurality of feet integral with the body and disposed below the inner surface for seating on a ground surface and supporting the pallet body. Each foot has a lower ground contacting edge. The combination also includes a plurality of boxes disposed on top of one another to form a stack. The stack is disposed within a pallet space defined between the feet and the pallet body. A retaining member is disposed around the pallet body and the stack so that the stack is securely held within the pallet space regardless of whether the pallet body is in a vertical standing position or a horizontal position.

19 Claims, 7 Drawing Sheets

FIG. 8
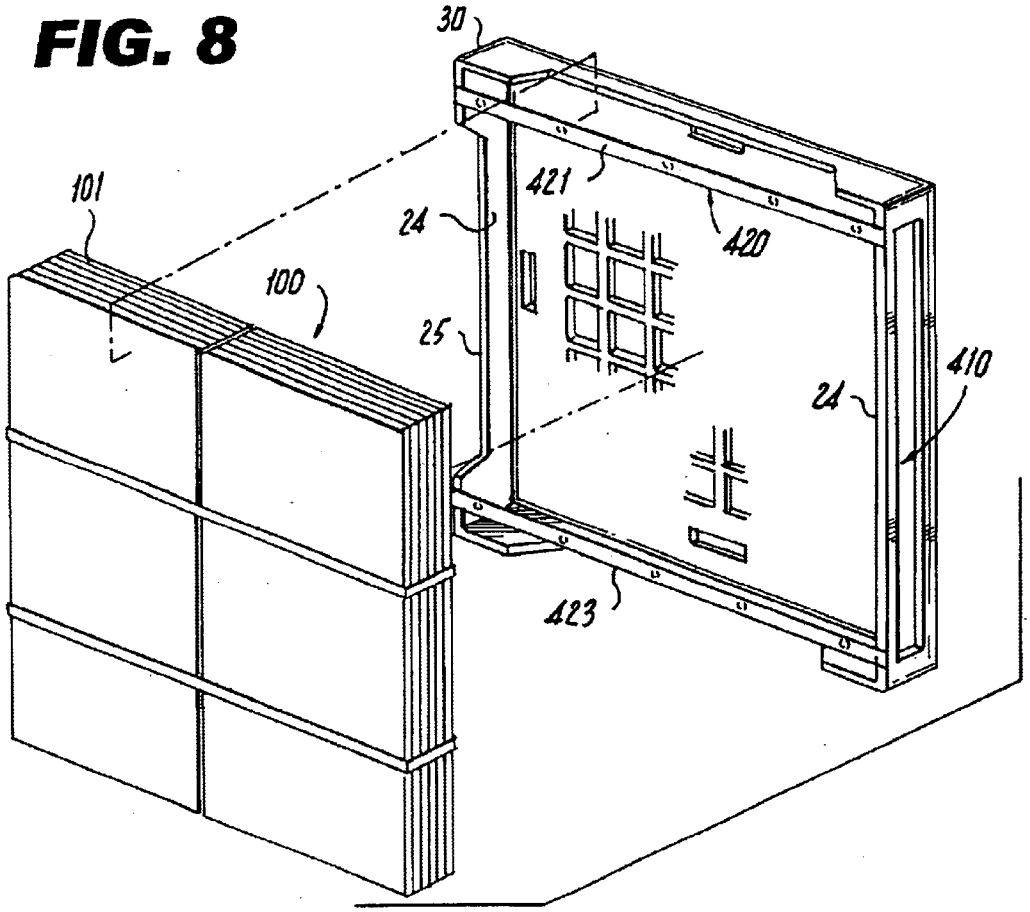
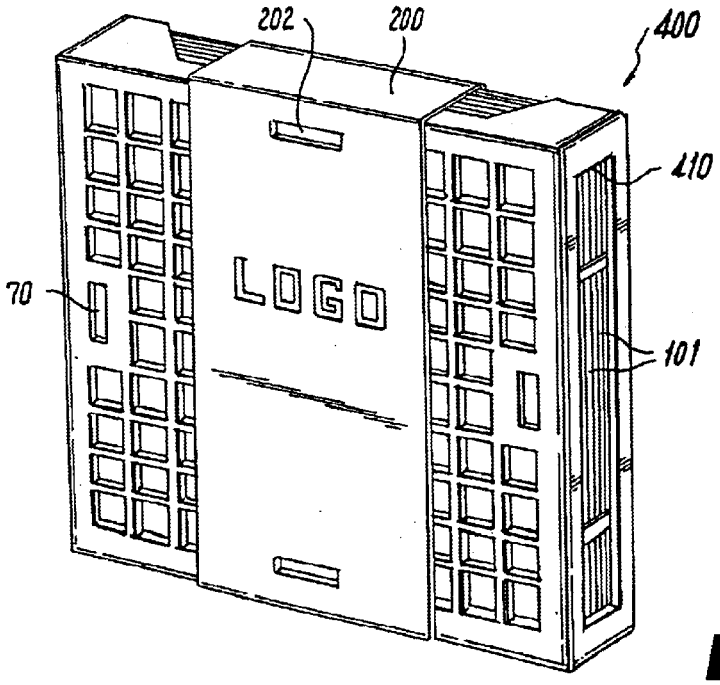
FIG. 9

FIG. 10
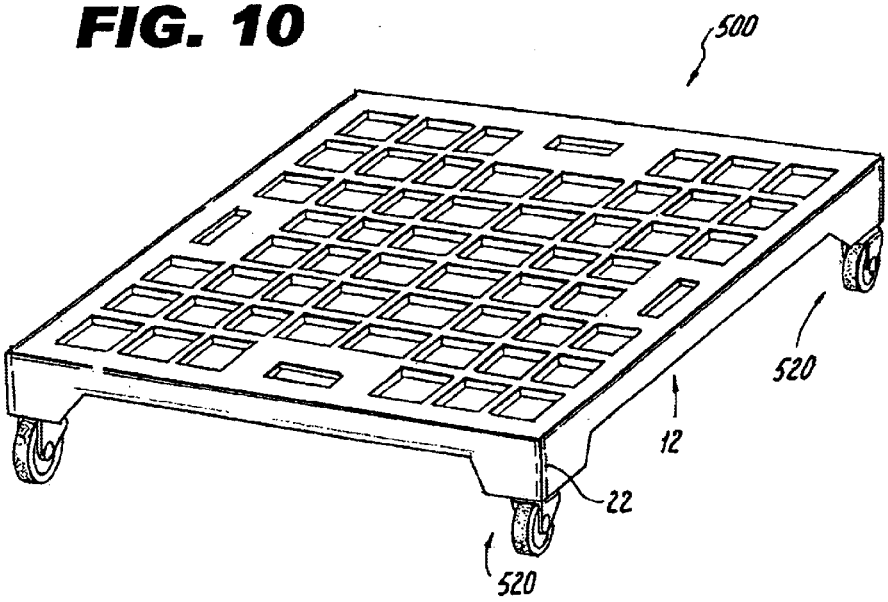
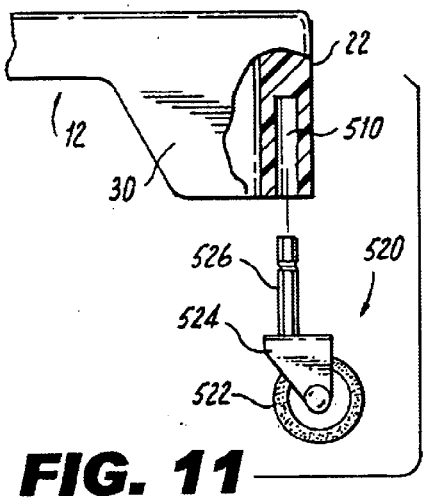
FIG. 11
FIG. 12
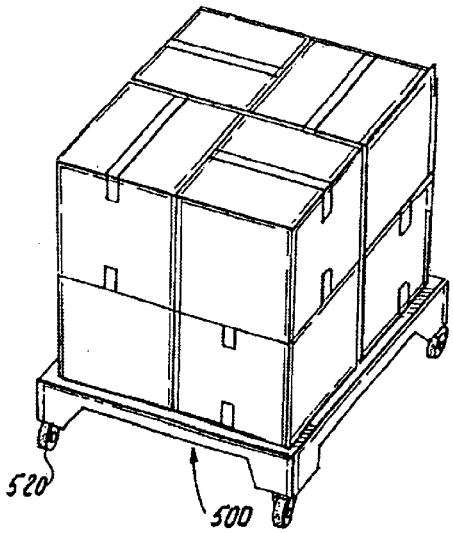

PALLET MEMBERS HAVING FEATURES FOR STORING BOXES AND OTHER ARTICLES

TECHNICAL FIELD

The present invention relates generally to pallet members, and more particularly to a pallet member that is constructed so that it includes an area that holds a number of unused boxes that are later used for storing articles that are placed on a load bearing surface of the pallet.

BACKGROUND

There are a number of different pallet constructions that are commercially available for purchase. A pallet is basically designed as a load support member that is constructed to make it easier for transporting and/or storing bulk matter that is placed on a load bearing surface thereof. For example, industrial type pallets have features formed therein that permit a fork lift truck to carry a pallet that may contain a number of boxes or other types of containers (e.g., sacks) that are arranged in a predetermined pattern on the load bearing surface.

Pallets are often made of wood. The weight and bulk of wooden pallets results in high costs for transporting, storing and disposal of the pallets. Another problem is handling and storing pallets after use. Often they must be transported for reuse or refurbishment, further adding to their cost. Often, they are destroyed after use, further adding to already overloaded landfill facilities.

It is also known to construct a pallet of corrugated paperboard. Although use of corrugated paperboard is advantageous with respect to weight, bulk and recycling issues, new complications are introduced. The added complexity of corrugated pallets required to provide adequate stiffness and load support strength complicates use with lift apparatus such as fork lift trucks. Also, a large number of different pieces are often required to assemble the pallets, especially if used with different sized containers. Large numbers of parts adds to the cost of inventory and assembly costs of the pallets.

In addition to industrial type pallets, pallets can be designed for applicability more in a residence or small office. More specifically, many people store items in boxes that are placed in a cellar or garage. While, the consumer can simply box such items and place them on the ground surface, this may lead to damage or destruction of the boxes themselves since paperboard boxes attract moisture and as the reader will appreciate, basement floors and garage floors tend to be damp. In addition, in areas that are prone to flooding and/or rodent infestation, it is advantageous to elevate the boxes off of the ground surface. By placing the boxes or containers on the pallet, the items are elevated from the ground surface.

Because boxes are the most common way for the consumer to store articles, the consumer has to first purchase or construct a pallet and then purchase boxes. At the very least, this purchasing requirement means that the consumer has to make two selections (which could be in two distant aisles) and also the consumer has to carry two separate bulky articles both to his/her vehicle and then therefrom to a residence or office.

It is therefore desirable to provide a pallet that is configured for a residential or small office type setting and which includes a feature that permits one stop shopping by incorporating a feature into the pallet such that a plurality of boxes can be retained and securely held within the pallet at least prior to the use thereof. In the art, the term "knocked down flat" (KDF) refers to a box that is in its flattened state.

SUMMARY

The present invention pertains to a pallet and storage container combination for retail sale. The combination includes a pallet having a body including an outer surface for supporting a load and an inner surface. The pallet has a plurality of feet integral with the body and disposed below the inner surface for seating on a ground surface and supporting the pallet body. Each foot has a lower ground contacting edge. The combination also includes a plurality of boxes disposed on top of one another to form a stack. In other words, the stack is formed of a number of boxes, each in a KDF state. The stack is disposed within a pallet space defined between the feet and the pallet body. A retaining member is disposed around the pallet body and the stack so that the stack is securely held within the pallet space regardless of whether the pallet body is in a vertical standing position or a horizontal position.

In another embodiment, a pallet and storage container combination for retail sale is provided and includes a pallet having a body including an outer surface for supporting a load and an inner surface. The pallet has a plurality of feet integral with the body and disposed below the inner surface for seating on a ground surface and supporting the pallet body. Each foot has a lower ground contacting edge, wherein at least one side of the pallet body has a longitudinal slot formed therein. A web is formed of at least two members that are integral to and extend between respective feet and each web member has a ground contacting surface when the feet seat upon the ground surface. The combination includes a plurality of boxes disposed on top of one another to form a stack, with the stack being disposed within a pallet space defined between the feet and the pallet body. The stack is dimensioned so that it and an individual box thereof can be received into and removed from the longitudinal slot even during use of the pallet. A retaining member is disposed around the pallet body and the stack so that the stack is securely held within the pallet space regardless of whether the pallet body is in a vertical standing position or a horizontal position, wherein removal of the retaining member permits one or more boxes to be removed through the longitudinal slot.

Further aspects and features of the exemplary apparatus disclosed herein can be appreciated from the appended Figures and accompanying written description.

BRIEF DESCRIPTION OF THE DRAWINGS

The invention will be more fully understood by reference to the following drawings which are for illustrative purposes only:

FIG. 8 is a bottom and side perspective view of the pallet of FIG. 7 with a bundle of unused storage boxes being removed therefrom;

FIG. 9 is a perspective view of the pallet of FIG. 8 with the bundle of boxes being contained within a compartment thereof for easy storage and sale of the pallet assembly;

FIG. 10 is a top and side perspective view of a pallet in accordance with a third exemplary embodiment;

FIG. 11 is a side elevational view of a section of a foot formed as part of the pallet and adapted to interlockingly receive a wheel member;

FIG. 12 is perspective view of the pallet of FIG. 10 in use with a plurality of boxes stacked thereon;

DETAILED DESCRIPTION OF THE PREFERRED EMBODIMENTS

Figure 1:
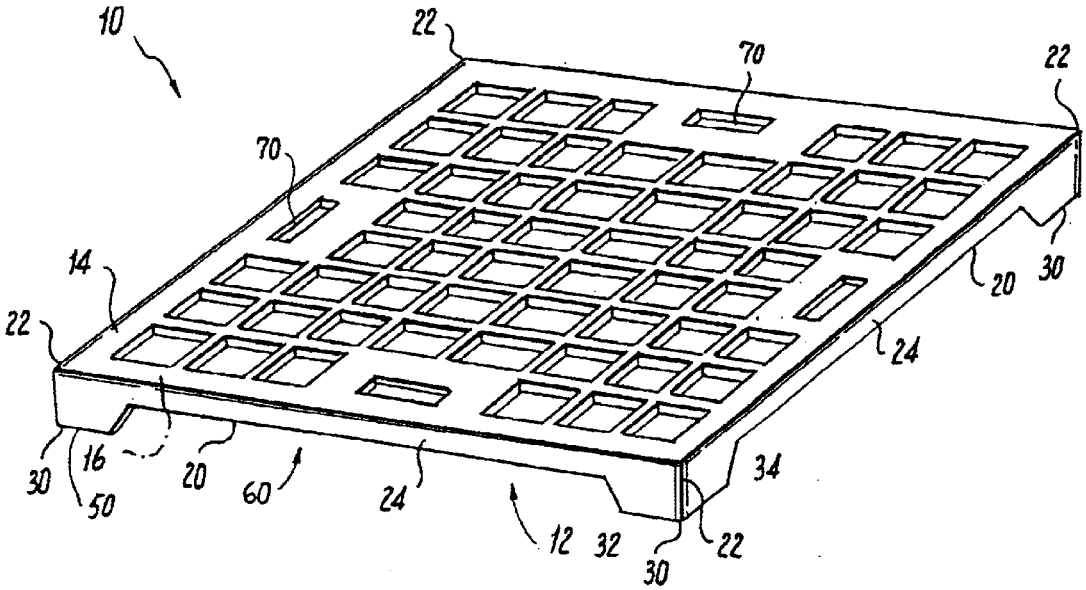
FIG. 1 is a top and side perspective view of a pallet in accordance with a first exemplary embodiment.
Figure 2:
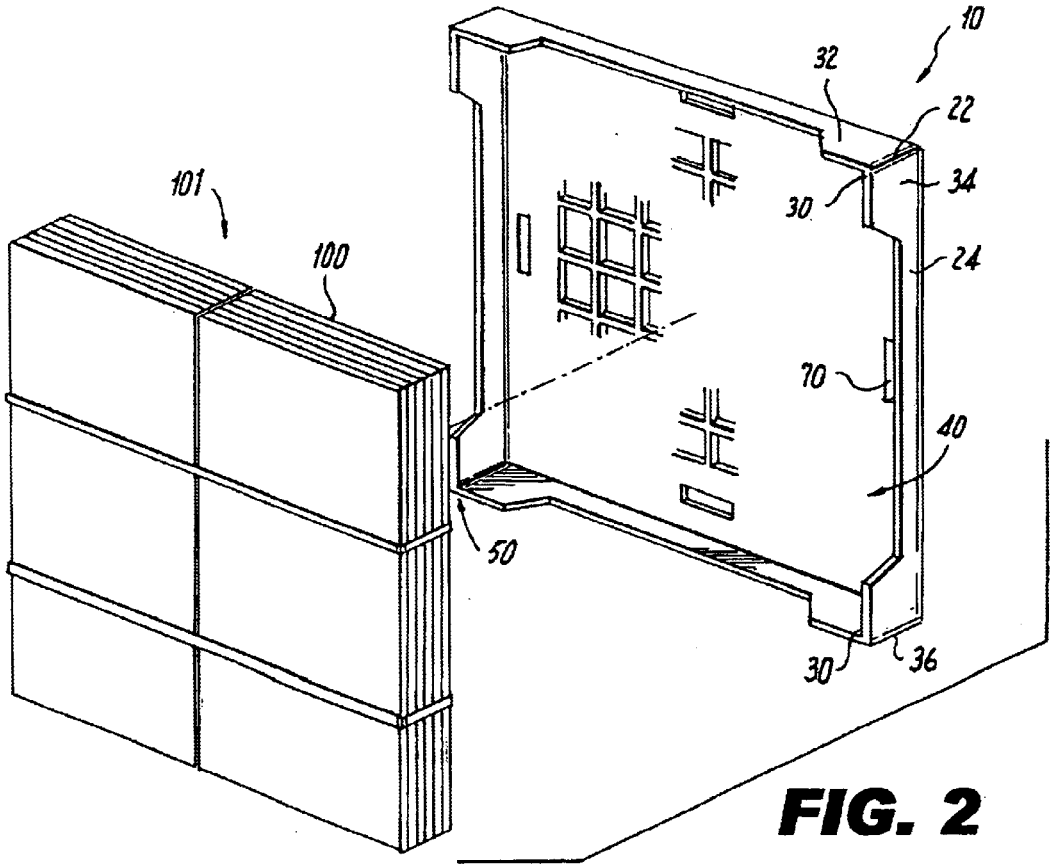
FIG. 2 is a bottom and side perspective view of the pallet of FIG. 1 with a bundle of unused storage boxes being removed therefrom.

Referring first to FIGS. 1 and 2, a pallet 10 according to one exemplary embodiment is illustrated. The pallet 10 has a support body 12 that includes an upper support surface 14 and an opposing lower surface 16. The illustrated pallet 10 is generally square shaped and therefore includes four sides 20 and four corner sections 22. Each of the sides 20 includes a side wall 24 that extends between one corner 22 and another corner 22 and is integrally connected to the support body 12. A plurality of feet 30 are formed as part of the body 12 with one foot 30 being arranged at each of the corners 22 of the body 12.

The feet 30 are formed as part of two adjacent and intersecting side walls 24 and they serve as the ground contact members such that when the pallet 10 is placed in a position of use, the feet 30 seat against a ground surface, such as a floor or the ground or the like and a space 40 is defined between the lower surface 16 and the ground surface. The height of the space 40 is dependent on the height of the feet 30 themselves since the height of the space 40 (distance D1 in FIG. 5 as measured from the lower surface 16 to the ground surface) can be increased by increasing the height of the feet 30 and conversely, the opposite is true.

Figure 3:
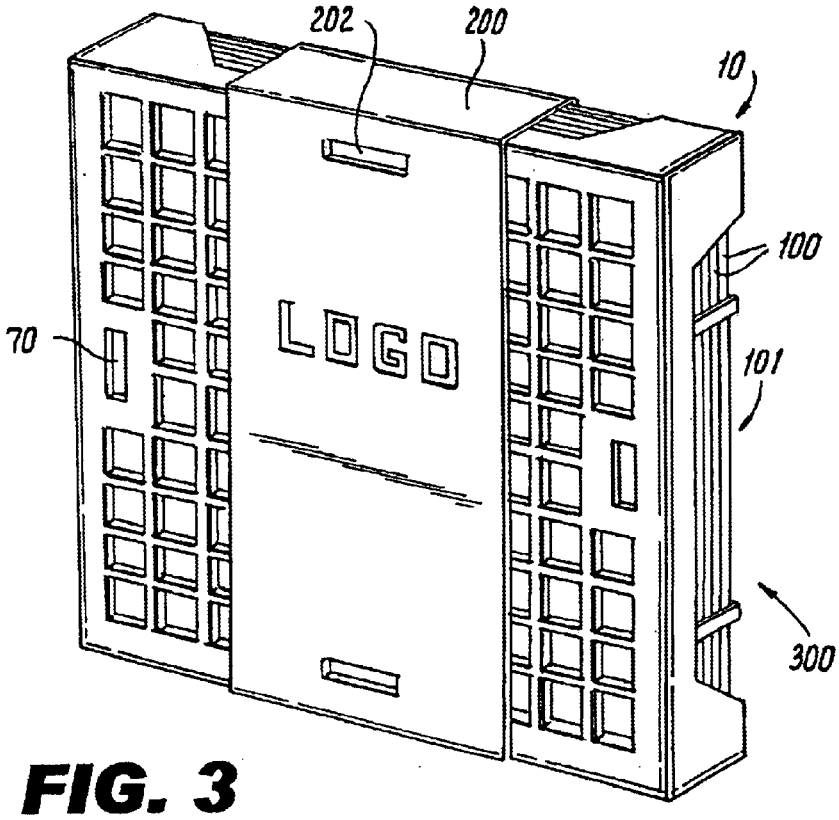
FIG. 3 is a perspective view of the pallet of FIG. 2 with the bundle of boxes being contained within a compartment thereof for easy storage and sale of the pallet assembly.
Figure 4:
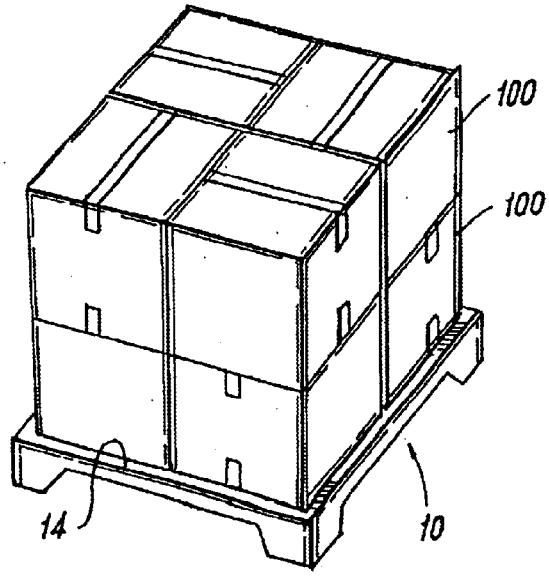
FIG. 4 is perspective view of the pallet of FIG. 2 in use with a plurality of boxes stacked thereon.
Figure 5:
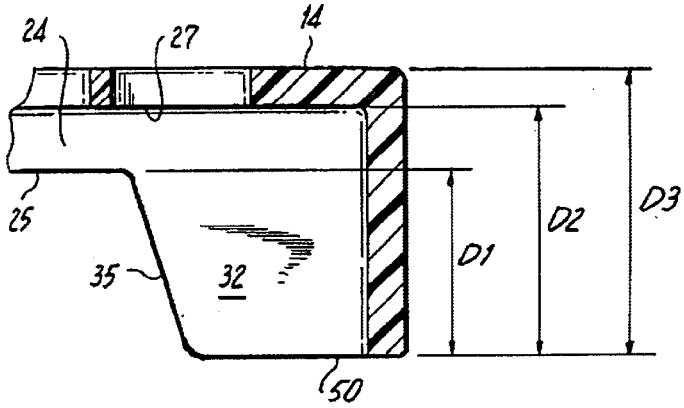
FIG. 5 is a side elevational view of a section of a foot formed as part of the pallet.

Referring to FIGS. 1–5, each foot 30 is defined by a first section 32 that is formed as part of one side wall 24 of the pallet 10 and a second section 34 that is formed on the adjacent side wall 24 of the pallet 10 that is formed at a right angle to the one side wall 24. Accordingly, the first and second sections 32, 34 are formed at a right angle with respect to one another. The first and second sections 32, 34 are generally a mirror image of one another and intersect one another so that a right angle is formed therebetween. As best shown in FIG. 5, the first section 32 and the rest of the sections of the feet each includes a planar lower edge 50 that contacts and seats against the ground surface. The lower edge 50 is parallel to both the lower surface 16 and the upper surface 14. The first and second sections 32, 34 each includes an inclined edge 35 that extends from the lower edge 50 to a lower edge 25 of the respective side wall 24. An upper edge 27 of the side wall 24 is integral with the lower surface 16 of the support body 12.

The first and second sections 32, 34 are joined together at a junction 36 with the inclined edges 35 being distally spaced from the junction 36. Because the lower edges 25 of the side walls 24 are elevated relative to the ground surface when the lower edges 50 of the feet 30 seat against the ground surface, a plurality of spaces 60 are formed between the lower edges 25 and the ground surface in a region that lies between facing inclined edges 35 on one face (one side wall 24) of the pallet 10. In FIG. 5, the distance between the lower edges 25 and the ground surface is indicated by D2, where D2 is less than D1. Distance D3 represents the distance from the upper support surface 14 to the ground surface and this is the distance that the articles which are stored on the upper support surface 14 are elevated from the ground surface.

Preferably, the body 12 and the feet 30 are formed as a single integral body as for example, by a molding process. While the illustrated body 12 is formed as a solid member, it will be appreciated that the body 12 can have a number of openings or the like formed therein so long as the body 12 offers sufficient structural support for its intended application. The formation of these openings eliminates the amount of material that is needed to form the body 12. Preferably, one or more handles 70 can be formed as part of the support body 12 proximate to one or more of the side walls 24. The formation of at least one handle 70 permits the consumer to easily carry the pallet 10 when it is in its packaged state as will be described hereinafter and also permits easy movement or adjustment of the pallet 10. In the illustrated embodiment, the support body 12 has four handles 70 that are arranged as two opposing pairs of handles 70. The handle 70 can extend completely through the pallet body 12 or it can be formed so that is a recessed gripping channel that does extend completely therethrough.

The support body 12 can have a number of surface modifying features formed as a part thereof. For example, the illustrated support body 12 has a plurality of intersecting raised ribs 72 that are arranged between the upper support surface 14 and the lower surface 16 such that upper edges of the ribs 72 lie within the same plane and define the upper support surface 14 that receives boxes and like when the pallet 10 is placed in use.

Figure 6:
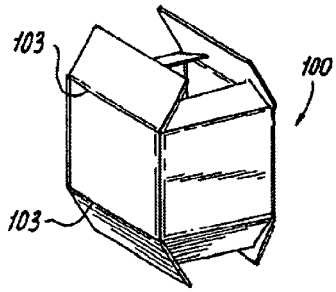
FIG. 6 is a perspective view of a corrugated box for use with the pallet of FIG. 1.

While the dimensions of the pallet 10 are variable, there is a correlation between the dimensions of the space 40 and the dimensions of the pallet 10 in that the space 40 is dimensioned to receive a plurality of boxes 100 that are stacked or otherwise arranged in an unfolded state. For example, the boxes 100 can be corrugated boxes (FIG. 6) that come in any number of sizes and are initially provided in an unfolded state (KDF) from which the consumer constructs the box by folding the box 100 along a number of fold lines 103. The corrugated nature of the boxes 100 is best illustrated in FIG. 2, where the boxes 100 are illustrated in their unfolded state. FIG. 4 illustrates the boxes 100 in their folded state where they are also supported on the upper surface 14 and are stacked relative to one another.

In one exemplary embodiment, the corrugated, unfolded boxes 100 are stacked on top of one another to form a bundle 101 of boxes 100. The bundle 101 has dimensions that permit it to be received within the space 40 and more specifically, the dimensions of the bundle 101 are such that it can be received between the feet 30 at the corners 22 of the support body 12. Preferably, there is only a small amount of clearance between the peripheral edges of the bundle 101 and the structure of the pallet 10. The bundle 101 thus has a complementary shape as the pallet 10 and more particularly, the bundle 101 preferably, has an identical shape as the support body 12. The more clearance between the peripheral edges of the bundle 101 and the pallet 10, the more room for the bundle 101 to move and shift relative to the pallet 10 and therefore, excessive clearance is not desired since this can lead to undesired movement (shifting) of the boxes 100 within the space 40 when the boxes 100 are disposed therein for storage. It will be appreciated that the boxes 100 can come already bundled into stack 101 or the boxes 100 can be loosely disposed one over another. Also, the stack 101 can be formed of boxes 100 of different sizes so long as the box 100 with the largest dimensions can be received in the space 40. Further and as is know, one or more of the boxes 100 can be of the type that has score lines formed therein. The inclusion of score lines permits at least one dimension of the box to be variable. For example, score lines can be formed so that the height of the box is variable by simply folding the box along a given set of score lines as opposed to other score lines.

In other words, the unfolded, corrugated boxes 100 are disposed, in their stacked form, against the lower surface 16 of the support body 12 with the corners of the bundle 101 being received in respective corners 22 of the pallet 10. When the boxes 100 are disposed in the space 40, the side walls 24 and the feet 30 prevent lateral movement of the boxes 100 and the only direction that the boxes 100 can easily move is a direction that is outwardly away (opposite) from the lower surface 16. The boxes 100 disposed within this space 40 against the lower surface 16 by aligning the corners of the bundle 101 with the corners 22 of the support body 12 and then lowering the bundle 101 into place until the bundle 101 seats flush against the lower surface 16. As can be seen by viewing FIGS. 2 and 4, the unfolded corrugated box 100 occupies a greater horizontal area as compared to the folded boxes 100 which occupy a greater vertical area. When the boxes 100 are stacked in bundle 101, the height of bundle is about equal to or less than the distance D1 so that when the bundle 101 is stored with the pallet 10, the boxes 100 does not extend beyond the lower edge 50 of the 30. This is shown in FIG. 3.

It will therefore be appreciated that the pallet 10 is constructed so that the space 40 is of sufficient size to receive the bundle 101 in such a manner that the boxes 100 are substantially hidden from view and such arrangement permits the boxes 100 to packaged with the pallet 10 to offer a convenient package or combination that encourages the consumer to buy this particular product. The bundle 101 can be retained between the side walls 24 and the feet 30 by a rupturable band 200 that is preferably a paper product so that the consumer can easily tear, cut or otherwise separate the band 200, thereby freeing the bundle 101 for removal. It will be appreciated that the boxes 100 that form the bundle 101 do not necessarily have to be attached to one another (e.g., as by a string or cord that is wrapped around the plurality of boxes 100 to create the bundle 101) but rather the boxes 100 can be stacked loosely on top of one another and then laid in place within the underside of the pallet 10 and subsequently, the band 200 is applied around the pallet 10 such that it securely holds the boxes 100 between the feet 30 and against the underside of the pallet 10. As shown in FIG. 3, the band 200 can have one or more openings 202 formed therein, each of which aligns with one handle 70 to permit the consumer to grasp the pallet 10 and easily carry the pallet 10 and the boxes 100 retained therein. For sake of brevity, the pallet 10 with boxes 100 securely retained on its underside by band 200 is referred to hereinafter as a pallet package 300.

By constructing the pallet 10 such that it receives and carries the boxes 100, a consumer is offered a much more attractive package since conventionally, the consumer had to first purchase or construct a pallet and then purchase boxes. At the very least, this purchasing requirement meant that the consumer had to make two selections (which could be in two distant aisles) and also the consumer had to carry two separate bulky articles both to his/her vehicle and then therefrom to a residence or office. In contrast, the pallet package 300 permits one stop shopping since the consumer simply needs to select the correct size pallet. It will be appreciated that a pallet 10 of one size can be packaged so that it has boxes 100 either of different size, construction and/or different number. While the pallet 10 is illustrated as having a square shape, it will be appreciated that the pallet 10 can be formed in any number of other shapes, such as rectangular, oblong, etc.

In one exemplary embodiment, the pallet 10 is square shaped with each side being 37 inches long and the distance D1 is 4 inches. This pallet 10 receives 8 corrugated boxes 100 in their unfolded (flattened) state with the dimensions of each box 100 being 36"×36" in the flattened state (which produces an 18"×18"×18" folded box). A bundle 101 of eight single wall boxes 100 that are stacked on top of one another has a height of about 3" and therefore, when the bundle 100 is disposed between the feet 30 and against the underside of the support body 12, there is a slight gap around the entire periphery of the bundle 101 and the side walls 24 and feet 30. This clearance permits the consumer to easily place his/her hand between the bundle 101 and the surrounding pallet support structure to grasp and remove the bundle 101 from the pallet 10. Further, because the height of the bundle 101 is less than the distance D1, the bundle 101 does not extend beyond the lower edge 50 of the feet 30. It will be appreciated that the foregoing measurements are merely exemplary in nature and are not limiting since the size of the pallet 10 and/or boxes 100 can readily be changed depending upon the application.

As previously mentioned, the exemplary pallet 10 is particularly intended for use in a personal setting, such as a basement location where it is undesirable for any of the boxes to be in contact with a damp or wet ground surface since such dampness and wetness can weaken and/or destroy the box 100. There are a number of other reasons why a consumer may wish to elevate articles from the ground surface. For example, if the consumer lives in an area that is prone to flooding, the pallet 10 can be used to elevate the articles to protect against such flooding. Also, the ground surface may be excessively dirty and therefore the pallet 10 elevates articles stored in the boxes 100 off the ground surface. In addition, the pallet 10 finds particular utility in a public storage facility, such as a self storage facility, where the user can rent a space and purchase the present packaged pallet 10 in the rental office.

Figure 7:
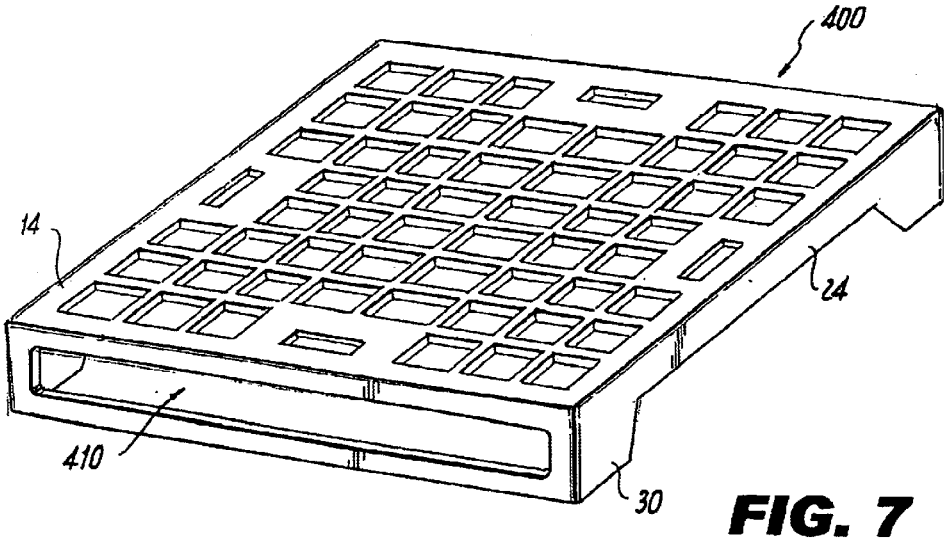
FIG. 7 is a top and side perspective view of a pallet in accordance with a second exemplary embodiment.

FIGS. 7–9 illustrate a pallet 400 according to another embodiment. The pallet 400 has a similar construction as the pallet 10 (FIG. 1) since the pallet 400 is designed to perform the same intended function as the pallet 10; however, the pallet 400 has at least one side slot 410 that permits the consumer to store and freely retrieve unused (flattened) boxes 100 even when the pallet 400 is being used to support a load on its upper support surface 14.

In this embodiment, the pallet 400 preferably includes a web 420 or the like that extends between the side walls 24 and more specifically, the web 420 can be attached to the feet 30 at or near the lower edge 50. The web 420 merely loosely defines a compartment 430 that is defined between the lower surface 16 (underside of support body 12) and the web 420 and which is intended to receive the bundle 101. For example, the web 420 can be in the form of thin intersecting elongated plate members that extend between the side wall 24 (e.g., the web 420 can have a lattice like structure). Alternatively, the web 420 can be in the form of slats that are arranged parallel to one another and extend from one side to an opposing side, with the number of slats being sufficient to retain the plurality of boxes 100.

It will also be appreciated that the pallet 400 can have the simple construction illustrated in FIG. 8 in which the web 420 consists of a first rail 421 that extends from one corner to another corner of the pallet 400 and a second rail 423 that extends from one corner to another corner of the pallet 400 with the first and second rails 421, 423 being substantially parallel to one another. The side slot 410 can be either located in one side wall 24 that has one of the rails 421, 423 running along a length thereof or the side slot 410 can be located in one side wall 24 that does not have one of the rails 421, 423 running along a length thereof. Alternatively, the rails 421, 423 can be configured in an "x" shape (i.e., criss-cross).

The at least one side slot 410 is formed relative to one side wall 24 and more specifically, the side slot 410 is defined by the lower edge 25 of the side wall 24 and also the web 420. On the side wall 24 that has the side slot 410, the respective feet 30 are modified so at to permit the consumer to always have access to retrieve and store the boxes 100 in their flattened state even when the pallet 400 is placed in use and supports a load on its upper surface 14. Thus, the consumer does not have to remove all of the boxes 100 from the underside of the pallet 400 before it is used by placing the feet 30 on the ground and placing a load on it. As the consumer needs boxes, the consumer simply removes one or more box 100 through the side slot 410. At the same time, the web 420 can be constructed so that the boxes 100 are not sitting on the ground surface. For example, the rails 421, 423 can include nubs or bosses (not shown) that are spaced therealong such that the boxes 100 seat thereon and therefore are even more elevated off the ground surface. While the rails 421, 423 are preferably integrally formed as part of the pallet 400, it will be appreciated that the rails 421, 423 can be separate members that are attached to the pallet body using conventional means, such as an adhesive or fasteners.

FIGS. 10–12 illustrate yet another embodiment where a pallet 500 is provided and has features that permit it to be converted from a pallet to a dolly. The pallet 500 is similar to the pallet 10 of FIG. 1 with the exception that each corner 22 of the pallet body 12 includes a recessed channel or slot 510 that releasably yet interlockingly receives a wheel member 520 (a caster). The wheel member 520 is of the type that is conventionally used with dolly type applications and includes a wheel 522 that is rotatable about a base 524. The base 524 includes a shaft 526 that is received within and releasably interlocks in the slot 510 using conventional locking mechanisms. If the wheel members 520 are not used, the pallet 500 functions as a stationary pallet that does not move. Conversely, if the wheel members 520 are used, the pallet 500 functions more as a dolly that can carry a load from one location to another location. The wheel members 520 can be sold with the pallet 500 or they can be sold separately.

The pallets 10 disclosed herein are constructed such that they each receive and carry the boxes 100 and therefore a consumer is offered a much more attractive package which permits one stop shopping since the consumer simply needs to select the correct size pallet.

Figure 13:
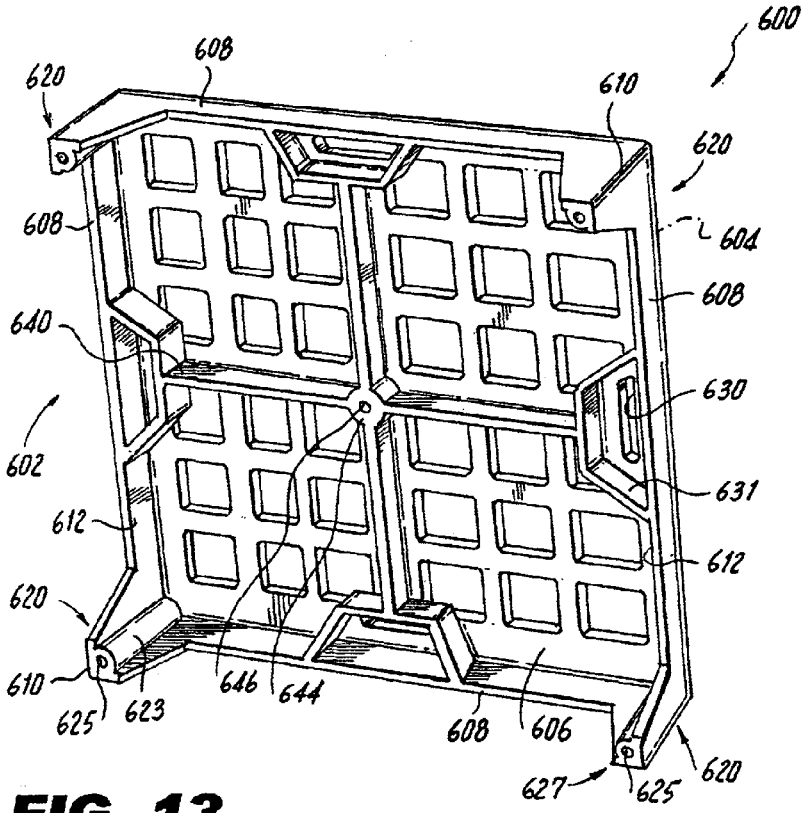
FIG. 13 is rear perspective view of a pallet in accordance with a fourth exemplary embodiment.
Figure 14:
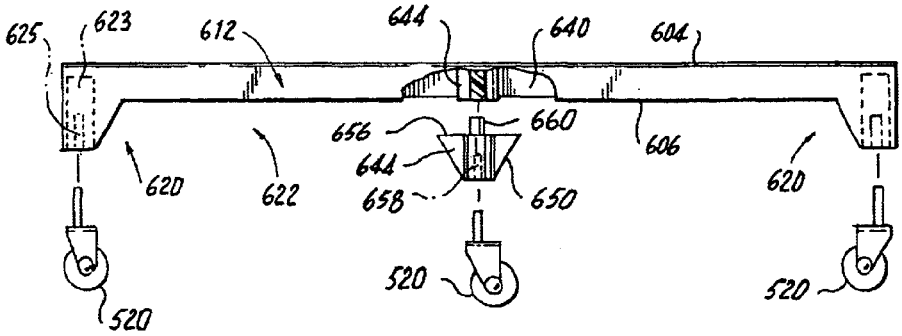
FIG. 14 is a side elevational view, partially exploded, of the pallet of FIG. 13.

FIGS. 13–14 illustrate a pallet 600 according to yet another exemplary embodiment. The pallet 600 is similar to the earlier disclosed pallets and therefore not all of the details of the pallet 600 are described in detail. The pallet 600 is preferably an integral unit that is formed of a plastic material that is preferably moldable to permit the pallet 600 to be formed using a molding process, such as injection molding. The pallet 600 has a support body 602 that includes an upper support surface 604 and an opposing lower surface 606. The illustrated pallet 600 is generally square shaped and therefore includes four sides 608 and four corner sections 610. Each of the sides 608 includes a side wall 612 that extends between one corner 610 and another corner 610 and is integrally connected to the support body 602. A plurality of feet 620 are formed as part of the body 602 with one foot 620 being arranged at each of the corners 610 of the body 602.

The feet 620 are formed as part of two adjacent and intersecting side walls 612 and they serve as the ground contact members such that when the pallet 600 is placed in a position of use, the feet 620 seat against a ground surface, such as a floor or the ground or the like and a space 622 is defined between the lower surface 606 and the ground surface. The side walls 612 at the corners 612 are angled downwardly so as to form the feet 620 and each foot 620 is also characterized by a base section 623 that in the illustrate embodiment has a rounded surface that faces the lower surface 606. Each foot 620 also has a bore 625 formed therein and more specifically, the bore 625 is formed in the base section 623 and is open at a distal end 627 (ground contacting end) of the foot 620.

The pallet 600 includes at least one handle 630 that is formed through the support body 602 and in one exemplary embodiment, there are four handles 630 that are spaced apart from one another (e.g., one handle 630 is formed adjacent one side wall 612 so that there are two pairs of opposing handles 630). Each handle 630 can have a raised wall 631 formed therearound on the lower surface 606 which better defined the handle area and better secures and contains the user's hand when the user is carrying the pallet 600.

The lower surface 606 of the pallet 600 has a structural reinforcing element formed as part thereof. More specifically, one exemplary structural reinforcing element is a plurality of ribs or rails 640 that are integrally formed as part of the lower surface 606. According to one exemplary embodiment, there are four rib sections 640 that are formed as part of the lower surface 606. Each rib section 640 extends between one handle wall 631 and a boss 644 that is formed in a center of the lower surface 606. The inclusion of ribs 640 increases the strength of the support body 602 since it serves as an additional strengthening element that bears and disperses the load. The illustrated ribs 640 have square or rectangular cross-sections and the boss 644 has a circular shape and has a bore 646 formed therein such that it is open at one end thereof.

Figure 16:
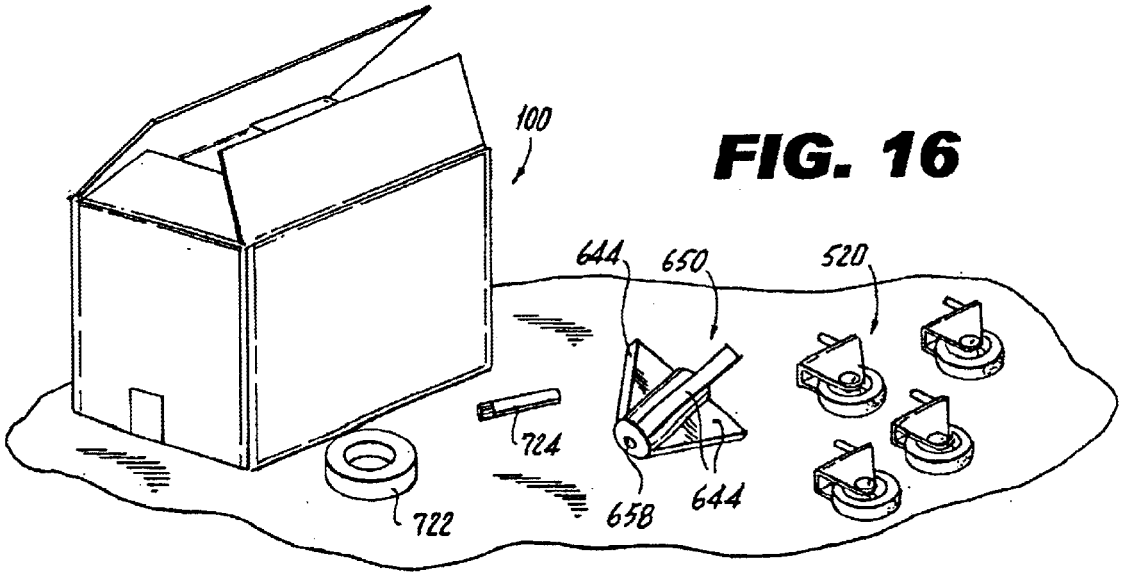
FIG. 16 is an exploded view of assorted items that are carried within the pallet of FIG. 15.

FIG. 14 shows a side elevational view of the pallet 600. It will be appreciated that the pallet 600 has certain features that permit it to be turned easily into a dolly device. More specifically, the bores 625 in the feet 620 are configured to receive conventional the wheel members (casters) 520. The casters 520 are inserted into the bores 625 so that a press fit or a snap fit results between the casters 520 and the feet 620 resulting in the casters 620 being securely attached to the feet 620 to permit movement of the pallet support body 602 (i.e., convert the pallet 600 into a dolly like structure). With respect to the boss 644 and the bore 646 formed therein, a center leg 650 is provided and engages the boss 644 in a snap fit manner such that the center leg 650 function as a center support structure and acts like another foot. The center leg 650 is also shown in detail in FIG. 16.

One exemplary center leg 650 includes a base section 652 that has a first end 654 and a second end 656. The illustrated base section 652 has a generally tubular structure with a bore 658 being formed at the first end 654 and a shaft or peg 660 protruding outwardly from the second end 656. The center leg 650 also includes a number of support structures formed as part thereof and more specifically, the center leg 650 has a plurality of integral fins 662 that extend from the second end 656 to an intermediate point. One exemplary fin 662 has a triangular shape with the side wall of the triangle that is located closest to the second end 656 being planar with the second end 656.

The center leg 650 is securely attached (e.g., a releasable snap fit connection) to the boss 644 by inserting the shaft 660 into the bore 646 using a snap fit or other type of engagement. When the center leg 650 is attached to the boss 644, the second end 656 and the planar portions of the fins 662 seat against the planar distal end of the boss 644 and the planar surfaces of the ribs 640. One caster 520 is then inserted into the bore 658 so that a press fit or a snap fit results between the caster 520 and the center leg 650 resulting in the caster 620 being securely attached thereto to provide an additional point of movement of the pallet support body 602. Because the center leg 650 and the caster 520 are attached to their various associated member in releasable manner, such as a snap fit, these components can be removed from their associated members, as when the pallet 600 is designed to seat stationary relative to the ground.

Figure 15:
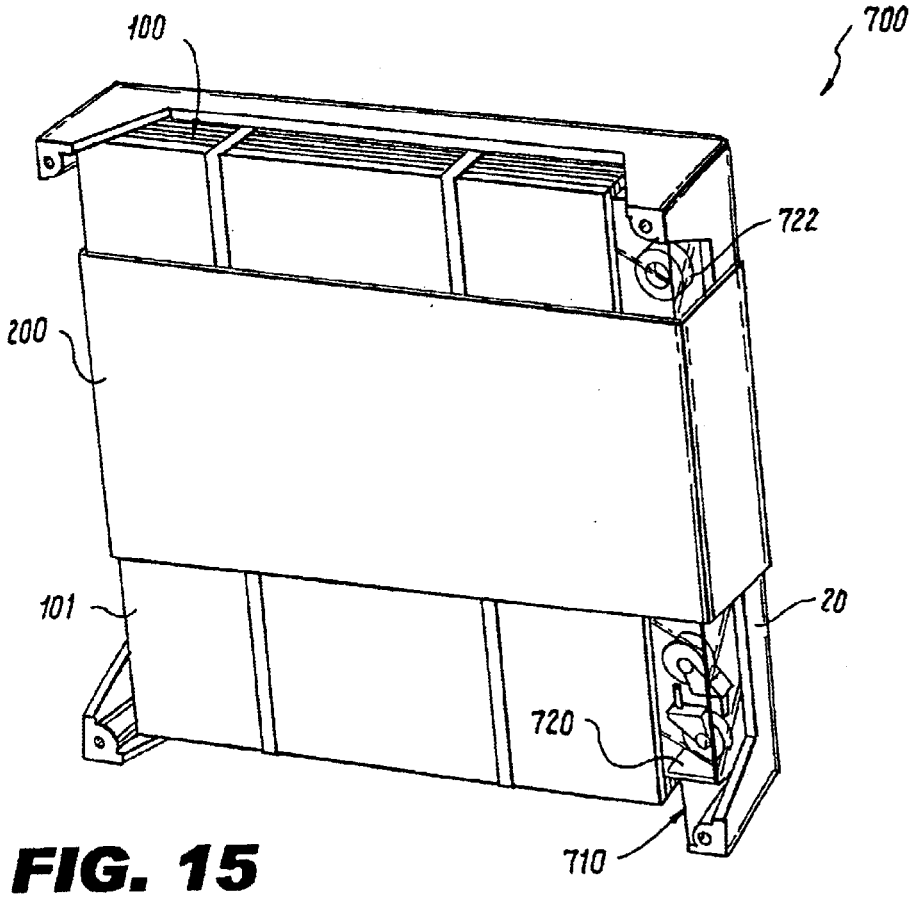
FIG. 15 is a rear perspective view of a pallet in accordance with a fifth exemplary embodiment.

FIG. 15 illustrates another aspect of the present invention. In FIG. 15, a pallet 700 is shown and this pallet 700 can be in the form of any of the previously disclosed pallets. In this embodiment, the stack 101 of boxes 100 is dimensioned so that the edges of the stack 101 do not extend completely to all four sides 20 (e.g., side walls 24). Instead, one edge of the stack 101 does not extend completely to a facing side 20 and therefore, a gap 710 is formed between this stack edge and the respective side 20. The gap 710 in the illustrated embodiment has a generally rectangular shape and extends between two feet 620. This gap 710 is intended to receive an assortment of articles. The assortment of articles can be packaged in a box or tray 720 or any other type of receptacle that is capable of holding the articles. For example, the receptacle 720 can be a styrofoam block that has a number of shaped recesses or depressions for receiving and securely only the articles that have particular utility in the use and set up of the pallet 700 and the boxes 100. Exemplary articles includes the casters 520, a roll of packing tape 722, the center leg 650, and a marker 724 and any number of other useful articles for the present application. There is not excessive space between the stack 101 and the receptacle 720 and the side wall 24 since it is not desirable for there to be excessive movement of either the boxes 101 or the receptacle 720 when the pallet 700 is assembled for sale using the band 200, which, as illustrated, extends around the pallet 700 and the stack 101 and the receptacle 720. The consumer thus gets a complete package at the point of sale and is therefore not required to purchase a number of separate products and transport the same home.

While this invention has been particularly shown and described with references to preferred embodiments thereof, it will be understood by those skilled in the art that various changes in form and details may be made therein without departing from the scope of the invention encompassed by the appended claims.

What is claimed is:

1. A pallet and storage container combination for retail sale, the combination comprising:

a pallet having a body including an outer surface for supporting a load and an inner surface, the pallet having a plurality of feet integral with the body and disposed below the inner surface for seating on a ground surface and supporting the pallet body, the plurality of feet having lower ground contacting edges;

a plurality of boxes disposed on top of one another to form a stack, the stack being disposed within a pallet space defined between the feet and the pallet body; and a retaining member disposed around the pallet body and the stack so that the stack is securely held within the pallet space regardless of whether the pallet body is in a vertical standing position or a horizontal position.

2. The combination of claim 1, wherein the pallet body includes a plurality of side walls that intersect one another and are integral to the pallet body to define a square shaped pallet, each corner of the pallet body having one foot formed thereat.

3. The combination of claim 2, wherein each foot at one corner includes a first section that forms a part of one side wall and a second section that forms a part of another side wall that intersects the one side wall at the one corner.

4. The combination of claim 3, wherein each of the first and second sections includes an inclined edge, each inclined edge extending from the lower ground contacting edge of the foot to a lower edge of one side wall, the lower edge of the side wall being disposed below the inner surface of the pallet body.

5. The combination of claim 1, wherein the pallet body has at least one handle opening formed completely therethrough from the outer surface to the inner surface.

6. The combination of claim 1, wherein a height of the stack is less than a distance from the inner surface of the pallet body to each of the lower ground contacting edges of the feet.

7. The combination of claim 1, wherein the band is a strip of paperboard that is snugly wrapped around the pallet body and the stack.

8. The combination of claim 1, wherein the pallet body has at least one handle opening formed completely therethrough from the outer surface to the inner surface and the band is a strip of paperboard that is wrapped around the pallet body and the stack, the band including an opening that aligns with the handle opening for permitting a user to grasp and carry the combined pallet body and stack when the band is wrapped therearound.

9. The combination of claim 1, wherein each foot includes a slot formed therein for detachably, interlockingly receiving a wheel member for converting the pallet body to a dolly.

10. The combination of claim 1, wherein each of the boxes is a corrugated box that has a number of fold lines, the corrugated box positionable between a flattened state and a folded assembled box state, the boxes being in the flattened state when they are arranged to form the stack.

11. The combination of claim 1, wherein the plurality of boxes comprises more than eight boxes.

12. A pallet and storage container combination for retail sale, the combination comprising:

a pallet having a body including an outer surface for supporting a load and an inner surface, the pallet having a plurality of feet integral with the body and disposed below the inner surface for seating on a ground surface and supporting the pallet body, the plurality of feet having lower ground contacting edges, wherein at least one side of the pallet body has a longitudinal slot formed therein;

a web formed of at least two members that are integral to and extend between respective feet, each web member having a ground contacting surface when the feet seat upon the ground surface;

a plurality of boxes disposed on top of one another to form a stack, the stack being disposed within a pallet space defined between the feet and the pallet body, the stack being dimensioned so that it and an individual box thereof can be received into and removed from the longitudinal slot; and a retaining member disposed around the pallet body and the stack so that the stack is securely held within the pallet space regardless of whether the pallet body is in a vertical standing position or a horizontal position, wherein removal of the retaining member permits one or more boxes to be removed through the longitudinal slot.

13. The combination of claim 12, wherein the web comprises a first rail that extends from one corner of the pallet body to another corner and a second rail that extend from one corner to another corner with the first and second rails being substantially parallel to one another.

14. The combination of claim 13, wherein each of the first and second rails includes an inner surface that has a number of nubs formed thereon for elevating the stack off of the inner surfaces of the first and second rails.

15. The combination of claim 12, wherein pallet body is square shaped and the feet are constructed so that the stack can not freely be removed along a side wall of the pallet body except through the longitudinal slot formed in one of the side walls.

16. A pallet and storage container kit for retail sale, the kit comprising:

a pallet having a body including an outer surface for supporting a load and an inner surface, the pallet having a plurality of feet integral with the body and disposed below the inner surface for seating on a ground surface and supporting the pallet body, the plurality of feet having lower ground contacting edges, the inner surface of the pallet body having a plurality of reinforcing ribs formed thereon and a boss protruding outwardly therefrom and being integrally connected with at least two reinforcing ribs, the boss having a bore formed therein;

a plurality of boxes disposed on top of one another to form a stack, the stack being disposed within a pallet space defined between the feet and the pallet body;

a holder that is disposed between one edge of the stack and one side of the pallet body, the holder holding at least one article that is selected from the group consisting of (a) a detachable leg that has a post for interlocking reception in the bore of the boss; (b) a plurality of wheel casters for detachable attachment to the plurality of feet and the detachable leg; (c) packing tape; and (d) a marker; and a retaining member disposed around the pallet body and the stack so that the stack and holder are securely held within the pallet space regardless of whether the pallet body is in a vertical standing position or a horizontal position.

17. The kit of claim 16, wherein the plurality of reinforcing ribs comprises four reinforcing ribs with each reinforcing rib having one end extending near or to one side wall and another end that is integral with the boss.

18. The kit of claim 16, wherein the holder is one of a paperboard box and a styrofoam holder.

19. The kit of claim 16, wherein the detachable leg has a bore formed therein at an end opposite the post for receiving one wheel caster.

* * * * *

UNITED STATES PATENT AND TRADEMARK OFFICE

CERTIFICATE OF CORRECTION

PATENT NO. : 6,905,021 B2 
DATED : June 14, 2005
INVENTOR(S) : Douglas H. Polumbaum et al.

It is certified that error appears in the above-identified patent and that said Letters Patent is hereby corrected as shown below:

Title page,
Item [75], Inventors, please delete "Sean O'Meallie, Colorado, CO (US)" and substitute -- Sean O'Meallie, Colorado Springs, CO (US) --.

Signed and Sealed this

Thirtieth Day of August, 2005

JON W. DUDAS
*Director of the United States Patent and Trademark Office*